US009587390B2

(12) United States Patent
Fishering

(10) Patent No.: US 9,587,390 B2
(45) Date of Patent: Mar. 7, 2017

(54) DEVICE FOR VENTING ODORS FROM A TOILET BOWL

(71) Applicant: Peter Fishering, Yucaipa, CA (US)

(72) Inventor: Peter Fishering, Yucaipa, CA (US)

( * ) Notice: Subject to any disclaimer, the term of this patent is extended or adjusted under 35 U.S.C. 154(b) by 0 days.

(21) Appl. No.: 15/099,572

(22) Filed: Apr. 14, 2016

(65) Prior Publication Data

US 2016/0305106 A1 Oct. 20, 2016

Related U.S. Application Data

(60) Provisional application No. 62/148,729, filed on Apr. 16, 2015.

(51) Int. Cl.
*E03D 9/05* (2006.01)
*E03D 1/34* (2006.01)
*E03D 11/13* (2006.01)

(52) U.S. Cl.
CPC ..... *E03D 9/05* (2013.01); *E03D 1/34* (2013.01); *E03D 11/13* (2013.01)

(58) Field of Classification Search
CPC ..... E03D 9/05; E03D 1/34; E03D 11/13
USPC ..... 4/213, 218, 348, 352
See application file for complete search history.

(56) References Cited

U.S. PATENT DOCUMENTS

| | | | |
|---|---|---|---|
| 4,494,255 | A | 1/1985 | Drummond |
| 4,989,276 | A | 2/1991 | Martens |
| 7,424,752 | B2 | 9/2008 | Antoniou |
| 8,505,123 | B2 | 8/2013 | Kennedy et al. |
| 2009/0126089 | A1 | 5/2009 | Smith |
| 2015/0167283 | A1 | 6/2015 | McKibbin |

*Primary Examiner* — Tuan N Nguyen
(74) *Attorney, Agent, or Firm* — Kenneth Avila

(57) ABSTRACT

An adapter and base plate that may be retrofitted to existing industry standard toilets to provide a capability to vent foul odors from bodily waste deposited into the toilet bowl. The toilet includes a bowl having flush holes disposed around a rim of the bowl for discharging water into the bowl, a water tank for containing a volume of water sufficient to cause the toilet to flush when the volume of water is discharged into the bowl, a flush and refill mechanism for flushing and then refilling the toilet, the flush mechanism controlling a flush valve that covers a drain at the bottom of the water tank. The adapter is fitted between the water tank and bowl with a first opening receiving the flush valve and a second opening connected to an exhaust fan by plumbing. The base plate may be translucent to allow LED lighting mounted to adapter to be cast about the bowl.

8 Claims, 8 Drawing Sheets

DEVICE FOR VENTING ODORS FROM A TOILET BOWL

CROSS-REFERENCE TO RELATED APPLICATIONS

This application claims priority from U.S. Provisional Patent Application No. 62/148,729 filed on Apr. 16, 2015. The entire disclosure of the prior application is considered to be part of the disclosure of the accompanying application and is hereby incorporated by reference.

BACKGROUND OF THE INVENTION

1. Field of the Invention

This invention relates to an accessory for lavatories that provide for the ventilation a toilet bowl by means of a fan which draws offensive odors from the toilet bowl and exhausted the odors to the outside of the home or building in which the accessory is installed.

2. Description of the Related Art

Flush toilets use water to dispose of human waste through a drain pipe into a sewer system. Exhausting malodorous air from a toilet is typically done using a ceiling-mounted fan. However, this is inefficient as the malodorous air must be drawn upwardly from the toilet to the fan on the ceiling. In recognition of this problem, a number of ventilated toilets have been developed for evacuating malodorous air in a more efficient manner. Generally, there are three types of ventilated toilets. A first type of ventilated toilet uses a filter or air scrubber to deodorize the malodorous air. The main disadvantages of this first type of ventilated toilet is that the filter or scrubber must be regularly replaced and that the deodorization effect may be ineffectual. A second type of ventilated toilet draws the malodorous air into the drain pipe and sewer. However, this can lead to back pressure especially in a septic system. Furthermore, if air is forced through the drain pipe and into the sewer, there would be no p-trap; as a consequence, there is no way to ensure that there is no back-drafting of sewage water. A third type of ventilated toilet uses a ventilation conduit as an interface between the water tank and the toilet bowl to exhaust the malodorous air from the toilet. The present invention is an improvement on this third type of ventilated toilets.

U.S. Pat. No. 4,494,255 to Drummond discloses a suction housing that is interposed between the water tank and toilet in a load-bearing relation. The suction housing is of cuboid shape having top, bottom and side walls respectively. The walls are sealingly secured together at the edges defining there between a closed chamber within. The rear wall supports an air duct that is in fluid communications with a fan that operates to draw air from the suction housing to the outside. The upper wall is provided with a tapered opening centrally thereof and bottom wall is provided with another opening of about the same size and in registry therewith. A frustoconically shaped duct has its larger diameter end sealingly secured at the perimeter to the annular edge of the top opening. The duct extends through the closed chamber and the bottom opening and slightly beyond resulting in a clearance between the exterior of the duct and the lower opening thereby providing for an annular intake port. When the fan is actuated offensive odors are drawn from the clearance into the suction housing through the air duct positioned in the rear wall and from there to the outside. However, the Drummond suction housing, being flat, does not allow for water that has entered the suction housing to drain as a result water pools within the suction housing. A problem that is further compounded if the toilet is not set exactly upright. Standing water allows bacteria and mold to develop creating the constant presence of unwanted odors from such sources and failing building codes in most if not all jurisdictions. Moreover, with the suction housing being as large as the base of the water tank, there is considerable volume of air to draw from requiring a larger fan. Finally, the air duct positioned at the rear wall of the suction housing is at a fixed position which is problematic if a wall stud is present behind the toilet as additional plumbing will be required to route the exhaust away from the wall stud.

U.S. Pat. No. 4,989,276 to Martens discloses a vent adapter that is installed in a water tank with certain structural modification to its interior. The first structural modification is that the water tank has a floor upon which water stored in the tank rests and a second floor below the first which is in contact with the toilet and attaches to the toilet in the same manner as industry standard water tanks. The second structural modification is the presence of a venting channel that allows for the movement of air from the enclosure between the two floors at the base of the water tank to an exhaust port at the top of the water tank. The enclosure between the two floors and the venting channel is sealed to prevent the entry of water that is stored in the water tank. The vent adapter is positioned between the two floors and is in registry communications with the flush valve above the first floor and the lower water discharge opening within second floor. The vent adapter confines to a great degree the passage of water during flushing operations to the space defined by the vent adapter while apertures about the circumference of the vent adapter allow for the movement of air between the vent adapter and the enclosure between the two floors. When water is not being flushed from the water tank into the toilet bowl a fan in fluid communications with the exhaust port at the top of the water tank draws air from the venting channel, in turn the venting channel draws air from the enclosure between the two floors, in turn the enclosure draws air from the apertures about the circumference of the vent adapter, in turn the vent adapter draws air from the water discharge portals about the rim of the bowl. However, the Martens disclosure requires, at time of retrofit, the replacement of the industry standard water tank with a water tank containing the certain structural modifications as described above adding a significant amount of cost to retrofitting of an existing toilet. In addition, any water escaping through the apertures about the circumference of the vent adapter and into the enclosure between the two floors remains within the enclosure as there are no means to encourage the water back through the apertures and into the vent adapter. This problem is further compounded if the toilet is not set exactly upright. Standing water allows bacteria and mold to develop creating the constant presence of unwanted odors from such sources and failing building codes in most if not all jurisdictions. Another problem is that the exhaust port positioned at the rear wall of the water tank is at a fixed position which is problematic if a wall stud is present behind the toilet as additional plumbing will be required to route the exhaust away from the wall stud.

U.S. patent publication 2009/0126089 to Smith discloses a tubular vent collar placed between the water tank and the bowl portions of a toilet that is secured by elongated bolts that attach the toilet tank to the toilet base. The vent collar is comprised of three separate components: an external housing tubular in shape with upper and lower openings of a smaller diameter than of the housing itself and a ventilation port on its circumference; a tubular baffle that fits through the housing's upper opening and meets the housing's lower opening thereby sealing the housing's upper and lower opening the baffle containing a plurality of openings about its circumference and allowing for the passage of water from the water tank to the bowl during flushing operations; and an adapter that sealingly threads into housing's ventilation port to provide a means for a remote fan to be in fluid communication with the ventilation port. As the baffle is of a smaller diameter than the housing there exists a gap between the baffle's exterior diameter and the housing's interior diameter. When water is not being flushed the fan may draw air from the water discharge ports about the rim of the bowl through the plurality of openings about the baffle's circumference and out through the housing's ventilation port to a discharge point directed to by the fan. Unlike the Martens disclosure the Smith disclosure may utilize the existing water tank when retrofitting a toilet however the shafts of the elongated bolts are exposed giving an unfinished look when the retrofit is complete and extra care will need to be taken when mounting the water tank to ensure that it is level as over tightening of one mounting bolt will cause the water tank to lean. The vent collar, being comprised of multiple components increases the cost of and the amount of time required to install the vent collar. Most troubling is that the gap between the base of the water tank and the top of the bowl created by the vent collar is difficult to clean leaving dust, residue from cleaners, and perhaps urine from males with an unsteady urine stream to collect creating the constant presence of unwanted odors from such sources and failing building codes in most if not all jurisdictions.

U.S. Pat. No. 7,424,752 to Antoniou discloses a gas removal device positioned between the toilet's water tank and bowl with gaskets forming appropriate seals between the gas removal device's lower surface and the bowl and the gas removal device's upper surface and the water tank. Like the Smith disclosure the existing water tank may be used when retrofitting the toilet with the Antoniou disclosure thereby requiring elongated bolts be used to fasten the water tank to the bowl with the gas removal device in between. The gas removal device defines an enclosed space within a shape that is generally elliptical with a longitudinal axis of symmetry when observed from above or below and rectangular when observed from the front, left, right, or rear sides. At the rear of the gas removal device is a tubular conduit that interfaces gas removal device with the building's soil stack and inline fan positioned to draw air from gas removal device though the fan, a one-way valve, and into the soil stack. At the opposing end of the gas removal device is an aperture allowing a conduit, such as the lower opening of a flush valve, from the water tank to pass into bowl with the aperture being of a larger diameter than the conduit and the resulting gap being used to draw air from the bowl when the fan is activated. When in operation for the purpose of removing foul air the fan is activated thereby opening one-way valve to the soil stack and drawing air. There are a number of problems with the Antoniou disclosure. First is that the gas removal device, being positioned between the tank and the bowl, creates a gap between the tank and the bowl that is equivalent to the height of the gas removal device and only partially occupied by the gas removal device as the gas removal device indicated in FIG. 2 does not provide for passage of bolts used to secure the water tank to the toilet bowl. As a result, the shaft of the bolts used to secure the water tank to the toilet bowl is exposed and creates an unsightly look. Second is that cleaning the surfaces within the gap will be difficult if not impossible leaving dust, residue from cleaners, and perhaps urine from males with an unsteady urine stream. A significant problem with the gas removal device the direct path from the gas removal device to the soil stack that is only interrupted by a one-way valve which uses a flexible diaphragm to block the flow of gas from the soil stack back to the gas removal device. Failure of the flexible diaphragm to be constantly closed would result in no foul odors being drawn from the bowl. Failure of the flexible diaphragm to be constantly open would cause foul odors from the soil stack to escape into the air about the toilet; a catastrophic event indeed! Finally, care will have to be taken during installation of the gas removal device as the gas removal device comprises variable length portion 21; described as hollow, corrugated, and flexible; is structurally weak and capable of rupture as the water tank is bolted to the toilet bowl or during usage over time.

U.S. patent publication 2015/0167283 to McKibbin discloses a ventilation adapter 5 that is inserted between the tank and bowl of the toilet. The ventilation adapter 5, is a simple double conduit, or tube within a tube, with a side-arm tube as an extension of the outer conduit. The double conduit has closure and rigidity provided by the conduit-end structure between walls of the two conduits at the tank end of the ventilation adapter. The bowl end of the double conduit ventilation adapter is open to both conduits. The space between conduit walls is not of a critical dimension but is approximately 0.25" in the preferred embodiment of the invention as represented in the figures. The side-arm tube, being of one to two inches in diameter, is in fluid communication with an air-flow pump that will draw air from the space between the conduit walls to an appropriate outside destination. When the air-flow pump is activated foul air rising within the bowl is drawn into the flush apertures the exist about the rim of the bowl, towards the rear of the toilet where the flush hole exists, through the space between the conduit walls of the ventilation adapter, into the side-arm tube, and finally through the air-flow pump where the foul air is them exhausted to an appropriate outside destination. Although the ventilation adapter is a simple device and thereby low cost, its usage creates a gap between the water tank and the bowl. As a result, the shaft of the bolts used to secure the water tank to the toilet bowl is exposed and creates an unsightly look. Second is that cleaning the surfaces within the gap will be difficult if not impossible leaving dust, residue from cleaners, and perhaps urine from males with an unsteady urine stream. In addition, sealing the ventilation adapter is difficult as the conduit-end structure between walls of the two conduits at the tank end of the ventilation adapter is to form a gasket seal with the bottom of the water tank by the bearing action of the water tank without guides to prevent movement by the gasket during installation while the opposite seal between the ventilation adapter and the bowl also exhibits the same problem and is compounded by the fact that only the rim of the outer conduit wall is used in forming a sealing connection with the bowl. Finally, the entire weight of the water tank on the bowl is only supported by the outer conduit wall of the ventilation adapter. Defects in the material comprising the outer conduit wall of the ventilation adapter; deterioration of the outer conduit wall over time or by contact with urine; improper assembly techniques may cause the outer conduit wall to fail thus causing damage to the toilet or harm to a user.

U.S. Pat. No. 8,505,123 to Kennendy et al. discloses an adapter disposed between the toilet's bowl and water tank so that the water tank and bowl remain operatively connected and water from the water tank can be discharged into the bowl to flush out the bowl in the usual manner. The adapter is structurally designed to support the water tank and is wide enough so that the mounting bolts attaching the water tank to the bowl pass through the adapter. The adapter includes a water conduit or passageway defining a drain that is in fluid communication with an upright pipe that extends into the water tank; the drain and upright pipe together forming a flush valve that is integrated into the adapter. During flush operations a flapper above the flush valve opens to allow water held by the water tank to pass through the drain and into the bowl by means of the apertures about the rim of the bowl. The adapter further includes an air exhaust pipe that is in fluid communications at one end with the drain and beyond with the apertures about the rim of the bowl and at the opposing end with a fan such that when the fan is activated air within the drain is drawn through the air exhaust pipe, and out to an appropriate outside destination. To evacuate any foul air within the bowl the fan is activated drawing foul air from within the bowl through the apertures about the rim of the bowl and into the drain where the foul air is prevented from entering the water tank as the flapper is close and must therefore pass through the air exhaust pipe and through the fan and out to an appropriate outside destination. Although the adapter solves some of the problems of prior adapters in that it has the strength to support the water tank with its internal design of lattice like structural support and it is of sufficient width to enclose the elongated blots necessary to mount the water tank to the bowl it is costly to mold and manufacture due to its lattice like structure it does have its problems. The adapter is costly due to the difficulty of manufacturing such a device with an internal lattice structure and that it includes components that already exists within the water tank. The exhaust is positioned at the rear wall of the adapter and is at a fixed position which is problematic if a wall stud is present behind the toilet as additional plumbing will be required to route the exhaust away from the wall stud. Finally, the adapter, while enclosing the elongated blots necessary to mount the water tank to the bowl, does nothing to add to the overall esthetic look of the toilet nor add any additional functionality other than venting to the toilet.

The prior an, while all disclosing a means of drawing foul air from the bowl by making dual use of the flush vents about the rim of the bowl in that when water is not being ejected from the flush vents that foul air from within the bowl may be draw into the flush vents following the same path as was taken by the water but in reverse up to the point where the water tank and bowl meet. There the foul air is intercepted and exhausted to some appropriate outside destination. However, the prior art have problems that must be overcome. Gaps between the water tank and the bowl is unsightly and difficult to clean allowing for dust, debris, bodily waste, and other unwanted materials to collect. When retrofitting the toilet with prior art devices components already in use must be discarded and replace with components included in the prior art leading to additional costs. Other prior art devices that fit between the water tank and bowl are designed to be flexible decreasing the structural integrity of the mount between the water tank and bowl. A number of prior an devices make use of internal structural components to ensure the integrity of the mount between the water tank and bowl resulting in increased manufacturing cost. All of the prior art devices required variations in design and manufacturing in order to be adapted to varying diameter of flush valves used by toilets that are being retrofitted. Finally, all of the prior art devices only accomplish the goal of removing foul air from the vicinity of the toilet to an appropriate outside destination and other needs such as lighting are left untouched.

BRIEF SUMMARY OF THE INVENTION

A traditional toilet is comprised of two major components, a bowl and a water tank that is mounted above and to the rear of the bowl and is in fluid communications with the bowl. In a toilet's normal state water exists both in the bowl and in the water tank with a valve within the water tank, called the flush valve, that prevents the water from within the water tank from moving into the bowl solely by gravitational force. The bowl has within itself two passages for the unidirectional movement of fluids from one point to another. At the rear of the bowl is an opening to the first of passage that is to receive water from the water tank that and direct such water received from the water tank to multiple openings spaced about the rim of the bowl so that the water received from the water tank is deposited into the bowl. At the bottom of the bowl is an opening to the second of passage that is to receive water and bodily waste within the bowl and direct the material received through a water trap and eventually to a waste line. Water within the bowl must overcome the blocking effect of the water trap in order to move through this second passage and into the waste line. When a flushing operation is initiated the flush valve within the water tank is opened so that water from within the water tank flow downwards through the flush valve and into the first passage within the bowl where it is directed to the openings spaced about the rim. The weight of the water directed into the bowl from the water tank through the first passage when added to the water already present in the bowl will overcome the blocking effect of the water trap resulting in much of the water within the bowl moving through the second passage and into the waste line. This disclosure and the disclosures of the prior art make use of the fact that a flushing operation is only initiated after bodily waste has been deposited into the bowl thus allowing the first passage to be used in the reverse direction to draw foul odors from out of the bowl and with an appropriate adapter mounted between the water tank and bowl intercepting the foul odors and transporting such odors to an appropriate outside destination.

The apparatus of this disclosure is comprised of two components that are mounted between the water tank and the bowl. The first component, the adapter, is generally elongated in shape and at one end encloses the drain of the flush valve with an appropriate gap such that the gap is in fluid communications with the opening of the first passage where water from the water tank is received during flushing operations while an exhaust port at the opposing end is to be connected via one or more sections of plumbing to an appropriate outside destination the plumbing containing an inline fan. When the fan is activated air is drawn through the first passage within the bowl in reverse of the direction taken by the water during flushing operations so that air above the water within the bowl is drawn into the opening spaced about the rim of the bowl through the first passage and out the flush opening at the rear of the bowl where the adapter resides. As the flush valve is closed the air then passes through the adapter, plumbing, and fan to be deposited at an appropriate outside destination. Design objectives of the adapter include low cost, simplicity of manufacture, of angles to encourage the flow of water away from the inside of the adapter. To meet these design objectives, the adapter is not capable of supporting the water tank due to its simplicity and angles. To provide the proper support for the water tank a simple flat plate of a thickness so that the water tank does not rest on the adapter with an outline that fills in the gap between the water tank and the bowl created by placement of the adapter so that the elongated bolts mounting the water tank to the bowl are hidden and there are no surfaces between the water tank and the bowl where dust, debris, bodily waste, and other unwanted materials may collect. The plate, being solid and of such surface area, provides plenty of support to stabilize the mounting of the water tank to the bowl. The plate may be manufactured from low cost materials such as plastics or conversely from high cost material such as granite or marble, be of any number of colors, or translucent so that lighting positioned at the rear of the plate may be broadcast about the area of the toilet. The two components complement each other so that manufacturing costs may be minimized, retrofits may be simplified, unsightly bolts are hidden, and cleanups are straightforward in addition to drawing foul odors rising from bodily wastes within the bowl to an appropriate outside destination.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

Neither this summary nor the following detailed description defines or limits the invention. The invention is defined by the claims.

BRIEF DESCRIPTION OF DRAWINGS

The present invention will become more fully understood from the detailed description and accompanying drawings, wherein.

DETAILED DESCRIPTION OF THE INVENTION

The following description of the preferred embodiment(s) is merely exemplary in nature and is in no way intended to limit the invention, its application, or uses.

Figure 1:
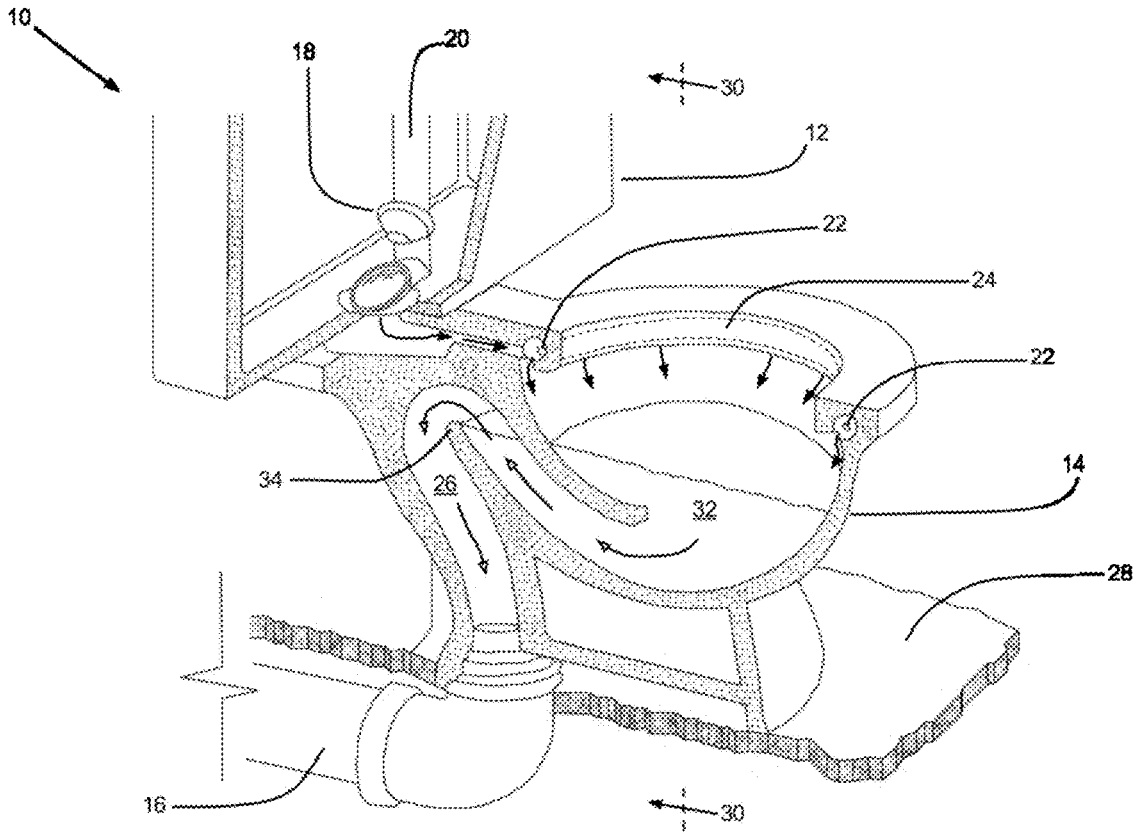
FIG. 1 is a perspective view of a toilet comprising both the bowl and the water tank with a portion of the front of the water tank being removed to expose key components therein and the bowl being a cross section to expose passages therein that related to the present invention.

FIG. 1 shows an industry standard two-piece toilet 10 that is comprised of water tank 12 that is mounted above and to the rear of bowl 14. The front left wall of water tank 12, as viewed in the sight of direction 30, has been removed to expose key internal components for the purposes of this disclosure; flapper 18 and flush valve 20. Flapper 18 is shown in its open position above the drain of flush valve 20. Normally flapper 18 is in its closed position which is resting on top of and sealing the drain of flush valve 20 from water stored in water tank 12. Bowl 14 is mounted to floor 28 above waste line 16 in a manner that the connection between bowl 14 and waste line 16 is sealed to prevent air or moisture from escaping from the connection. Within bowl 14 there are two passages; intake passage 24 with first opening found at the rear of bowl 14 where water is received from water tank 12 and with multiple second openings in the form of apertures 22 found about the top rim of bowl 14 so that water received from water tank 12 and travelling through intake passage 24 is deposited into basin 32 within bowl 14 as shown by the flow arrows with solid arrowheads; outtake passage 26 with first opening at the base of basin 32, includes water trap 34, and second opening at the joinder of bowl 14 and waste line 16 as shown by the flow arrows with clear arrowheads.

A flushing operation is initiated when flapper 18 is lifted thereby allowing water within water tank 12 to flow through flush valve 20 into intake passage 24 where the water will travel about the rim of bowl 14, through apertures 22, and finally deposited into basin 32. As water is received by basin 32 from apertures 22 the resistance provided by water trap 34 is eventually overcome allowing water within basin 32 to pass into outtake passage 26, through water trap 34, and out to waste line 16. After basin 32 has been emptied of water, water trap 34 will reassert itself and block the flow of water through outtake passage 26 and basin 32 will begin to collect the water received through apertures 22. Basin 32 will continue to received water through apertures 22 while water remains in water tank 12 and flapper 18 is opened. When water tank 12 is emptied of water, flapper 18 will drop over drain of flush valve 20 thereby sealing the fluid connection between water tank 12 and bowl 14 permitting water to again be added and stored within water tank 12 while any water remaining in intake passage 24 will continue to flow into basin 32 where the water will collect.

When not engaging in a flushing operation water needed for the next flushing operation is stored in water tank 12, outtake passage 26 is blocked by water trap 34 with any residual water from prior flushing operation in basin 32, and intake passage 24 is clear of water. The present invention makes use of the fact that when toilet 10 is not engaging in a flushing operation, intake passage 22 is clear of water and apertures 22 are in fluid communications with the air above basin 32. Thus by creating a low pressure zone of air at intake passage 24 first opening the air above basin 32 will be drawn into apertures 22 towards intake passage 24 first opening in a flow that is reversed from the flow of water during flushing operations. The present invention is able to create a low pressure zone of air at the origin of intake passage 24 in a manner that does not allowing for the pooling of water and may facilitate the growth of mold or bacteria, provides steady and firm support for water tank 12, is simple to manufacture and install, and makes use of existing toilet 10 components when retrofitting toilet 10.

Figure 2:
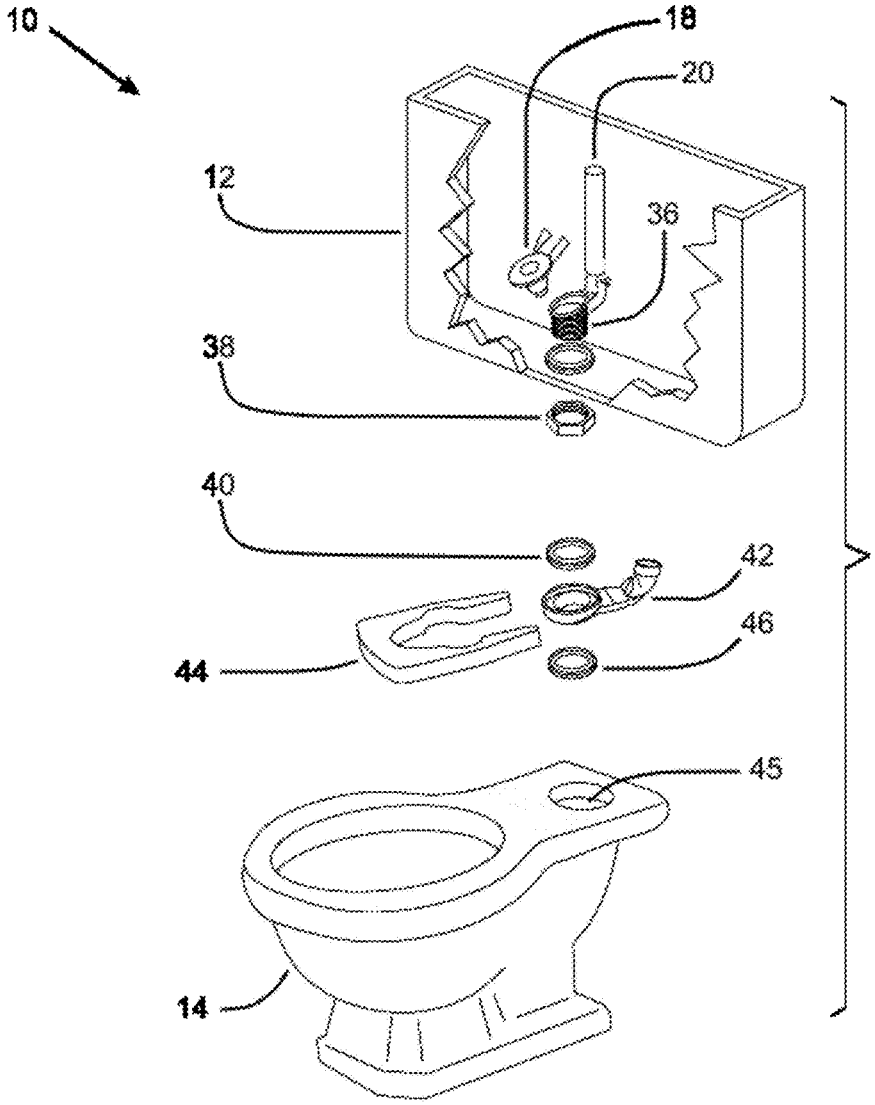
FIG. 2 is an exploded view of a toilet comprising both the bowl and the water tank with a portion of the front of the water tank being removed to expose key components therein and the adapter and base plate of the present invention.

The purpose of FIG. 2 is to show the retrofitting of toilet 10 of the present invention. The key components of the present invention shown in FIG. 2 include upper gasket seal 40, adapter 42, base plate 44, and lower gasket seal 46. FIG. 2 is an exploded view of toilet 10 comprising both bowl 14 and water tank 12 with a portion of the front of water tank 12 being removed to expose flapper 18 and flush valve 20.

Figure 8:
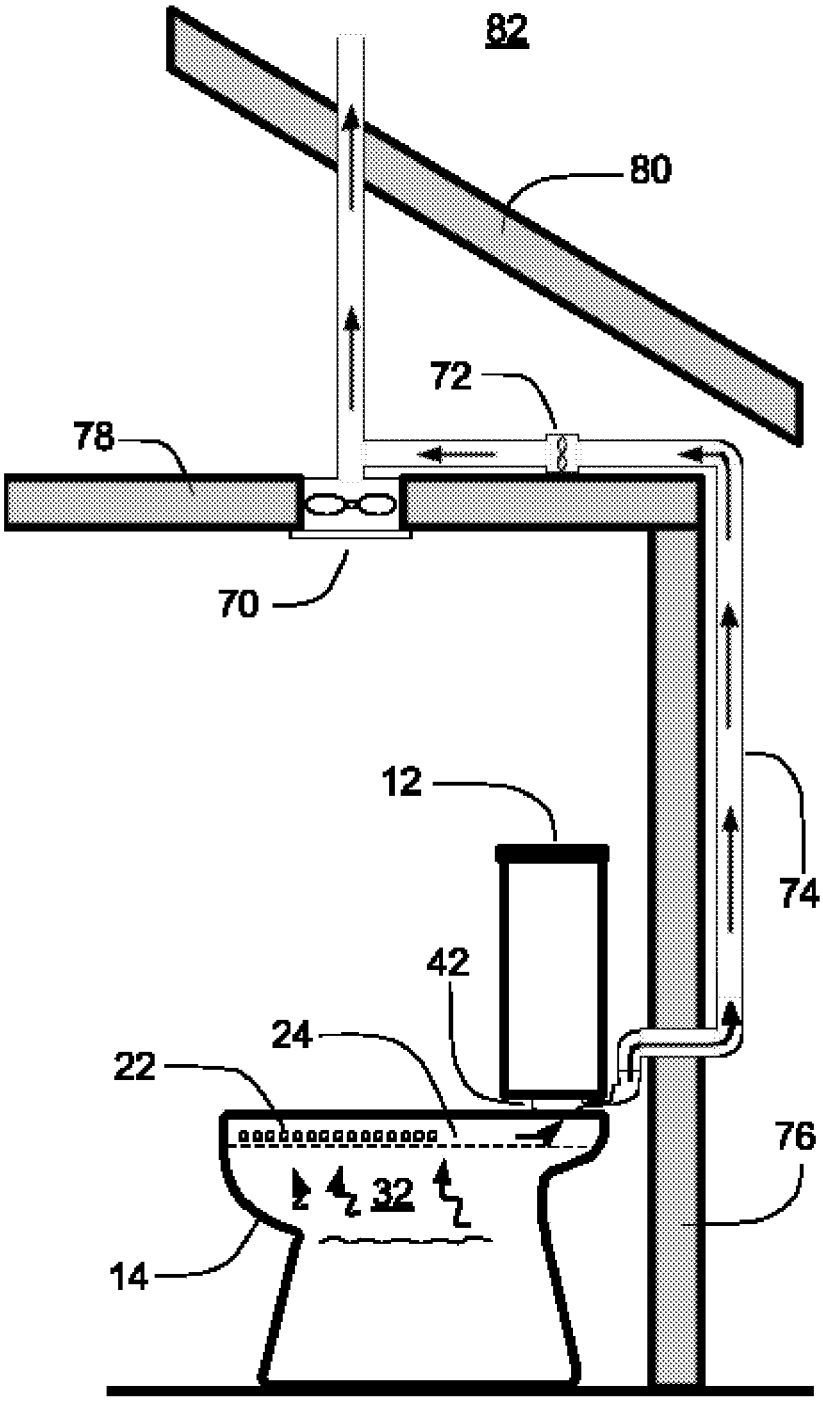
FIG. 8 shows the toilet with the adapter interpose between the water tank and bowl incorporated into the odor extraction system of a toilet closet.

Flush valve 20 is comprised of two tubular segments in parallel with each other with one tubular segment being longer and of a smaller diameter than the other and both tubular segments connected together so as to be in fluid communications with each other the connection being at the base of the longer tubular segment and the top of the shorter tubular segment the shorter tubular segment being shank 36. Shank 36 is threaded and passes through the base of water tank 12 and into first opening 45 of intake passage 24 at the rear of bowl 14. Flush valve 20 is secured to water tank 12 by threading and tightening shank nut 38 about the length of shank 36 that extends beyond the base of water tank 12. Upper gasket seal 40 seals the joinder of shank nut 38 to adapter 42 while lower gasket seal 46 seals the joinder of adapter 42 to bowl 14. Base plate 44 encloses adapter 42 about the front, left, and rights sides and provides indents for the passage of elongated blots used to mount water tank 12 to bowl 14. Base plate 44 width is such that water tank 12 is easily and safely supported while base plate 44 height is such that any weight brought by water tank 12 is not carried by adapter 42. Adapter 42 is comprised of two openings. The first opening is of such a diameter that shank 36 is able to enter within first opening of adapter 42 with a gap between the outer diameter of shank 36 and inner diameter of adapter 4 first opening. Adapter 42 second opening is in fluid communication with first opening and by means of plumbing in fluid communications with an exhaust fan. The plumbing and exhaust fan are shown in FIG. 8.

Figure 3:
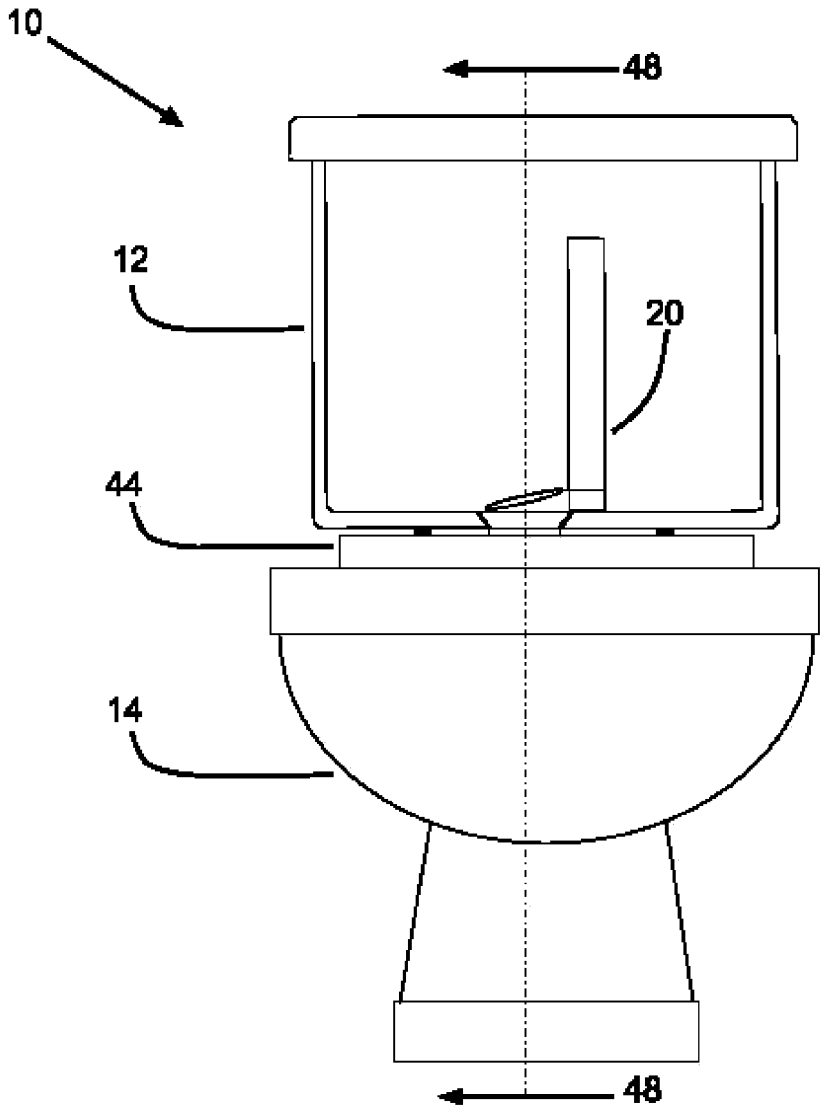
FIG. 3 shows a front elevation view of the toilet with the base plate interposed between the water tank and the bowl.

FIG. 3 shows a front elevation view of toilet 10 with base plate 44 interposed between water tank 12 and bowl 14. As water tank 12 is typically manufactured from a hard but fragile material such as ceramic, base plate 44 may have on its upper surface rubber mounts so that when mounting bolts that connect water tank 12 to bowl 14 are tightened water tank 12 does not crack as the rubber mounts provide some degree of cushion between water tank 12 and base plate 44.

Figure 4:
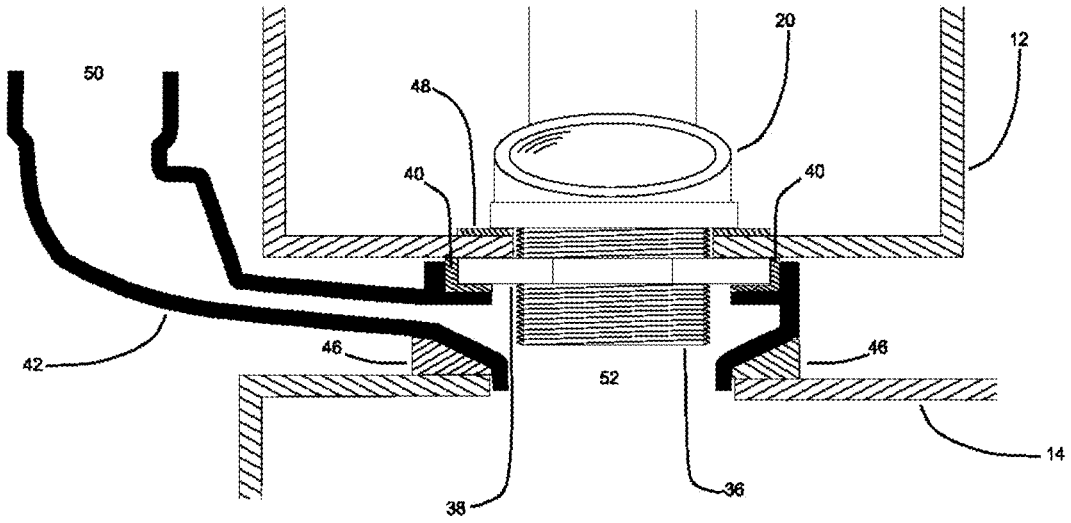
FIG. 4 is a cross-sectional of the adapter of the present invention between the water tank and the bowl, the cross-sectional view being taken through section 48-48 in FIG. 3.

FIG. 4 is a cross-sectional view of adapter 42 in its suspended position between water tank 12 and bowl 14, the cross-sectional view being taken through section 48-48 in FIG. 3. Base plate 44 and bolts used to mount water tank 12 to bowl 14 are not shown so that adapter 42 and its interfaces with water tank 12 and bowl 14 may be appreciated. Adapter 42 is not designed to support the weight of water tank 12 nor is adapter 42 design to maintain water tank 12 in a level and upright position. As such adapter 42 does not come into direct contact with water tank 12 and bowl 14 but only indirectly by upper gasket seal 40 and lower gasket seal 46. Adapter 42 is generally elongated with openings at both of the opposing ends that are in fluid communications with each other: input port 52 and output port 50. Input port 52 inner diameter is larger than shank 36 outer diameter and input port 52 receives shank 36 with shank 36 being securely mounted to water tank 12 by shank nut 38. During flushing operations water within water tank 12 passes through shank 36 and into bowl 14 intake passage 24. Any water that does manage to enter adapter 42 during flushing operations will travel into bowl 14 intake passage 24 by simple gravitational forces as all of adapter 42 exposed internal surfaces slope downward. Upper gasket seal 40 provides a sealing fit between shank nut 38 and adapter 42 while lower gasket seal 46 provides a sealing fit between adapter 42 and bowl 14 however at no time does adapter 42 come into direct contact with water tank 12 or bowl 14. Water tank 12 and bowl 14 only come into direct contact with base plate 44 that is not shown in this figure but encloses adapter 42 about the front, left, and right sides. When water is not being flushed through shank 36 an exhaust fan connected downstream from output port 50 may draw air present within the gap that exists between the outer diameter of shank 36 and the inner diameter of input port 52. As input port 52 is in fluid communications with intake passage 24 air will then be drawn through apertures 22 located above and about basin 32 in a direction that is reversed from that taken by water during flushing operations. Foul odor rising from human waste product that has been deposited into basin 32 is attracted by the air that is being drawn into apertures 22 by of the exhaust fan and is itself drawn into apertures 22. By continued action of the exhaust fan the foul odor passes through intake passage 24 in a manner reversed to that of water during flushing operations, through the gap between adapter 42 and shank 36 to a point as so designated by placement of the exhaust fan.

Figure 5:
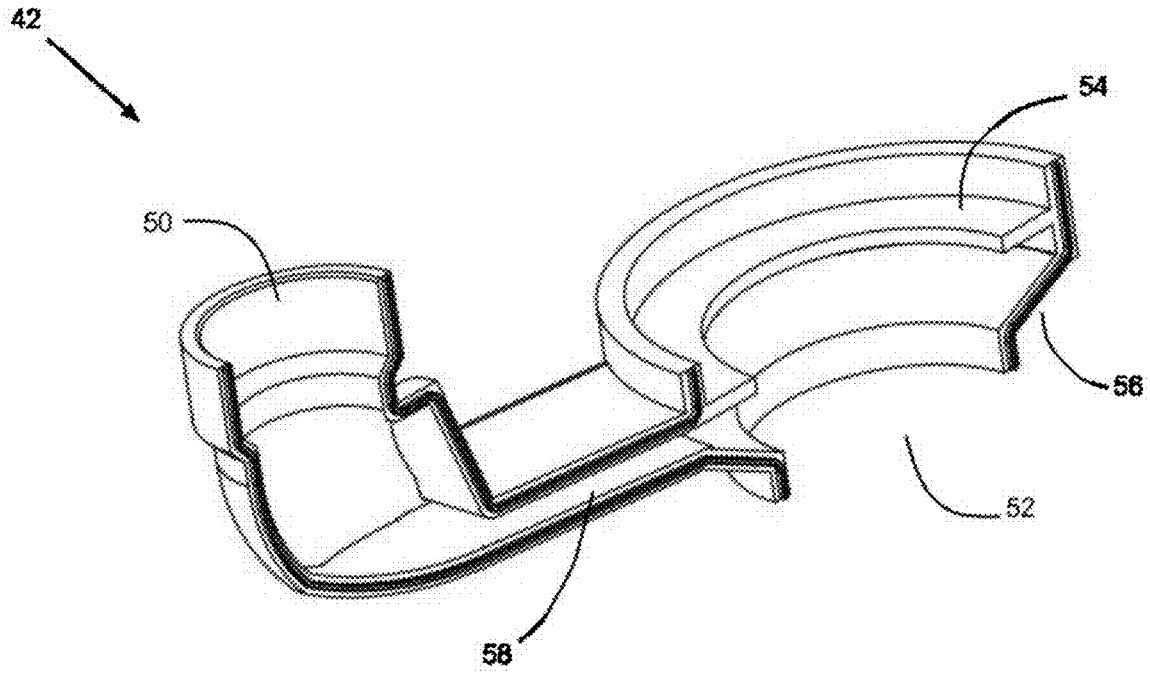
FIG. 5 is a perspective view showing a cross section of the adapter of the present invention.

FIG. 5 is a perspective view showing across section of adapter 42. It is important to note that adapter 42 is symmetrical about its longitudinal axis both internally and externally facilitating the manufacturing of adapter 42 by injection molding processes. As adapter 42 is not designed to support any weight of consequence, as its sole function is being the means by which to draw air from intake passage 24, it may be manufactured using lightweight and low strength materials and, more importantly, its surfaces may be angled for the purposes of preventing the pooling of water rather than supporting water tank 12 in a level position. Input port 52 has an inner diameter such as when receiving shank 36 a gap will exist between shank 36 outer diameter and input port 52 inner diameter. Internal passage 58 allows for input port 52 to be in fluid communications with output port 50 and is designed with a downward slope so that any water entering input port 52 during flushing operations or otherwise will flow back towards input port 52 and out of adapter 42. Flange 54 provides sufficient support to retain upper gasket seal 40 so that a sealing fit may be created between adapter 42 and shank nut 38. Angled surface 56 provides sufficient support to lower gasket seal 46 so that a sealing bit may be created between adapter 42 and bowl 14. Angled surface 56 encourages the flow of any water present within adapter 42 towards input port 52 and out of adapter 42.

Figure 6:
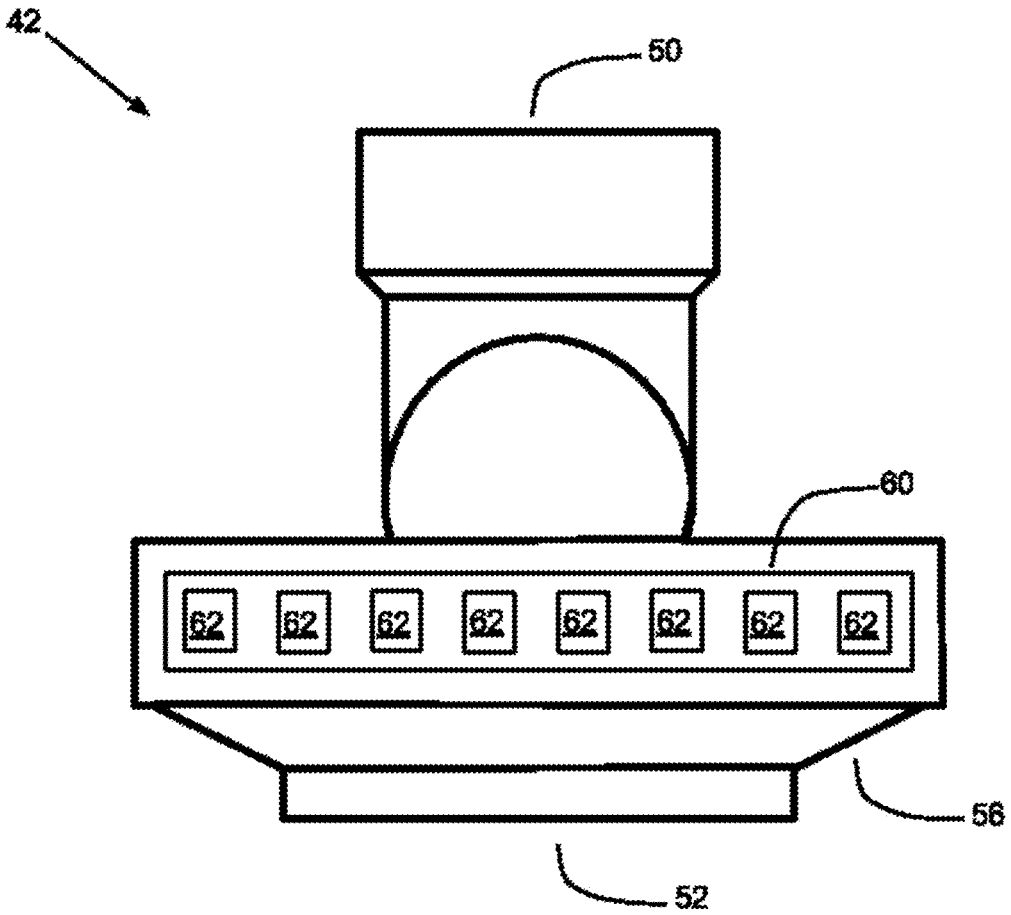
FIG. 6 is a front elevation vie of an embodiment of the adapter of the present invention further comprising a string of light emitting diodes (LEDs).

FIG. 6 is a front elevation view of an embodiment of adapter 42 further comprising a string of tri-colored light emitting diodes (LEDs) attached to adapter 42 as LED strip 60. LED strip 60 is comprised of a plurality of tri-colored LED 62. Being tri-colored LED strip 60 may be configured to display the entire spectrum of colors as the individual red, green, and blue LEDs within each LED 62 may be set to different intensities. LED strip 60 is commercially available and further may be configured remotely by smartphone applications. With LED strip 60 adapter 42 may function as a night light in the toilet closet casting a soft glow about toilet 10. LED strip 60 is powered by an electrical source and may be activated by a motion sensor detecting the entry of a human into the water closet or a manual switch.

Figure 7A:
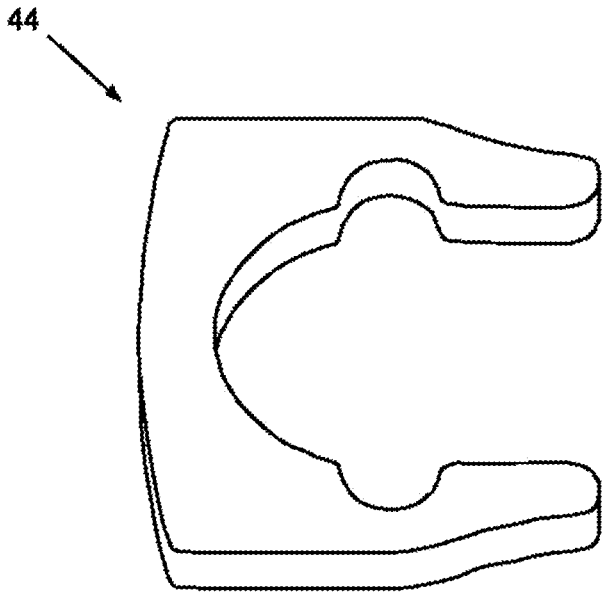
FIG. 7A is a perspective view showing a first embodiment of the base plate and FIG. 7B is a perspective view showing a second embodiment of the base plate.
Figure 7B:
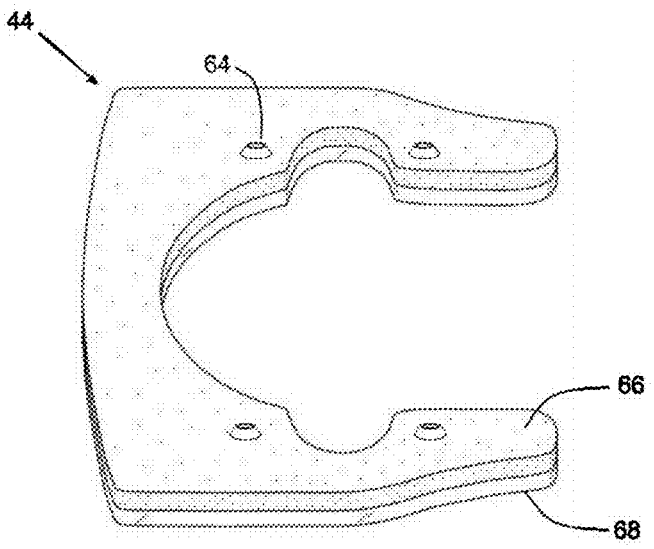

FIG. 7 is a perspective view showing the base plate 44 in two embodiments. In both embodiments base plate 44 lower and upper surfaces are flat with the sides exhibiting curves for an aesthetic appearance; however, the sides of base plate 44 may be manufactured with linear planes. The flat upper and lower surfaces of base plate 44 allows base plate 44 to maintain water tank 12 in a level position and prevent water tank 12 from crushing adapter 42 that is to be positioned within the void encompassed by base plate 44. A further advantage of the void encompassed by base plate 44 is that adapter 42 is allowed to swivel so that the position of output port 50 varies from one extent to the other. This will simplify plumbing requirements if a wall stud so happens to be present directly behind toilet 10. The first embodiment shown in FIG. 7A shows base plate 44 constructed from a single piece of material such as plastic for cost effectiveness or with granite in order to achieve a luxurious look. Being constructed of a single material this embodiment is extremely simple to manufacture. The second embodiment shown in FIG. 7B shows base plate 44 constructed from two materials each within its own layer. Upper layer 66 is of a solid material such as plastic or granite while lower layer 68 is of a translucent material so that light from LED strip 60 may pass through providing a light source to illuminate bowl 14. In addition, this second embodiment of base plate 44 contains four rubber pads 64 attached to the upper surface. Pads 64 provide a cushion between water tank 12 and base plate 44 so that water tanks made from ceramic do not crack when being mounted to bowl 14.

FIG. 8 shows the toilet with adapter 42 interpose between water tank 12 and bowl 14 being incorporated into the odor extraction system of a toilet closet. Typically, a water closet only contains a single exhaust fan 70 mounted into ceiling 78 and when activated draws air from within the water closet through plumbing 74 to an appropriate outside destination 82. However, this arrangement envelops the user with foul odors rising from basin 32. When toilet 10 has been retrofitted with adapter 42 activation of exhaust fan 72 draws foul odor rising from basin 32 into apertures 22, through intake passage 24, through adapter 42, through plumbing 74, through exhaust fan 72, to an appropriate outside destination 82.

It will be understood that the present invention provides a system for removal of foul odors from a toilet which is simple to manufacture, durable, easy to install, and effective.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A ventilated toilet comprising:

a bowl having a passage about the rim of the bowl with a plurality of openings for the discharge of water into the bowl, the passage receiving water for discharging into the bowl from an opening at the rear of the bowl, the openings in fluid communications by means of the passage;

a water tank containing a volume of water sufficient to cause the toilet to flush when the volume of water is discharged into the passage;

a flush mechanism for flushing the toilet, the flush mechanism controlling a flush valve that covers a drain at the bottom of the water tank, the flush valve further comprising a shank that protrudes beyond the drain and registering with the opening in bowl to receive water for discharging into the bowl the flush valve secured to water tank by a shank nut threaded onto shank;

a refill mechanism for refilling the water tank;

an adapter suspended between the bowl and the water tank, the adapter:

being generally elongated in shape defining a cavity therethrough with first and second openings, symmetrical about its longitudinal axis, the first opening having an annular structure to receive the shank, the annular structure further containing a flange to support a gasket to seal the joinder of the annular structure to the shank nut and a sloping surface to support a second gasket to seal the joinder of the annular structure to the bowl, the annular structure not in contact with either the water tank or the bowl, the second opening connected by plumbing means to an exhaust fan thereby in fluid communications with the exhaust fan, and interior planes of the sloping surface cause water present within the adapter to flow out of the adapter through the first opening; and a base plate of a form to enclose the front, left, and right sides of the adapter and elongated bolts used to mount the water tank to the bowl, wherein the base plate supports the water tank and removes loading forces on the adapter.

2. The ventilated toilet of claim 1, wherein said adapter further contains a LED strip about the front of the first opening and a means for activating the LED strip by a motion detector or a manual switch.

3. The ventilated toilet of claim 2, wherein the color of the LEDs within the LED strip is controlled by a smartphone application.

4. The ventilated toilet of claim 1, wherein said base plate further contains a plurality of rubber mounts on its upper surface to cushion the joining of the water tank to the base plate when the elongated bolts are tightened.

5. The ventilated toilet of claim 1, wherein said base plate has a linear upper surface and a linear lower surface and nonlinear sides.

6. The ventilated toilet of claim 1, wherein said base plate further contains two or more layers of different materials.

7. The ventilated toilet of claim 6, wherein one or more said layers is translucent.

8. A ventilated toilet comprising:

a bowl having a passage about the rim of the bowl with a plurality of openings for the discharge of water into the bowl, the passage receiving water for discharging into the bowl from a horizontal opening on a platform at the rear of the bowl, the openings in fluid communications by means of the passage;

a water tank containing a volume of water sufficient to cause the toilet to flush when the volume of water is discharged into the passage;

a flush mechanism for flushing the toilet, the flush mechanism controlling a flush valve that covers a drain at the bottom of the water tank, the flush valve further comprising a shank that protrudes beyond the drain and registering with the horizontal opening in bowl to receive water for discharging into the bowl the flush valve secured to water tank by a shank nut threaded onto shank;

a refill mechanism for refilling the water tank;

an adapter suspended between the bowl and the water tank, the adapter:

being generally elongated in shape defining a cavity therethrough with first and second openings, symmetrical about its longitudinal axis, the first opening having an annular structure to receive the shank, the annular structure further containing a flange to support a gasket to seal the joinder of the annular structure to the shank nut and a sloping surface to support a second gasket to seal the joinder of the annular structure to the bowl, the annular structure not in contact with either the water tank or the bowl, the second opening connected by plumbing means to an exhaust fan thereby in fluid communications with the exhaust fan, interior planes of the sloping surface cause water present within the adapter to flow out of the adapter through the first opening, and a LED strip about the front of the first opening and a means for activating the LED strip by a motion detector or a manual switch; and a base plate of a form to enclose the front, left, and right sides of the adapter and elongated bolts used to mount the water tank to the bowl, wherein the base plate supports the water tank and minimize loading forces on the adapter, wherein the base plate further contains a plurality of rubber mounts on its upper surface to cushion the joining of the water tank to the base plate when the elongated bolts are tightened and contains two or more layers of different materials with at least one layer being translucent.

* * * * *